US009629442B2

(12) United States Patent
Ponx

(10) Patent No.: US 9,629,442 B2
(45) Date of Patent: Apr. 25, 2017

(54) SECURED SPORTS EQUIPMENT BACKPACK

(71) Applicant: David A. Ponx, Pueblo, CO (US)

(72) Inventor: David A. Ponx, Pueblo, CO (US)

( * ) Notice: Subject to any disclaimer, the term of this patent is extended or adjusted under 35 U.S.C. 154(b) by 47 days.

(21) Appl. No.: 14/672,043

(22) Filed: Mar. 27, 2015

(65) Prior Publication Data

US 2016/0278507 A1 Sep. 29, 2016

(51) Int. Cl.

| | |
|---|---|
| ***A45F 3/04*** | (2006.01) |
| ***A45C 13/02*** | (2006.01) |
| ***A45C 13/20*** | (2006.01) |
| *A45F 3/00* | (2006.01) |

(52) U.S. Cl.

CPC ..... *A45F 3/04* (2013.01); *A45C 13/02* (2013.01); *A45C 13/20* (2013.01); *A45F 2003/003* (2013.01)

(58) Field of Classification Search

CPC .. A45F 3/04; A45F 2003/003; A45F 2200/05; A45F 2200/0566

See application file for complete search history.

(56) References Cited

U.S. PATENT DOCUMENTS 4,449,655 A * 5/1984 Germe ..... B63C 11/22 224/153
4,693,402 A * 9/1987 Comeau ..... A45F 3/04 206/315.1
4,767,039 A * 8/1988 Jacober ..... A45F 3/04 224/153
4,883,207 A * 11/1989 McArthur ..... A45F 3/04 190/113
5,012,964 A * 5/1991 Falletta ..... B63C 11/26 224/153

(Continued)

FOREIGN PATENT DOCUMENTS

CN 202375282 U 8/2012
CN 203106128 U 8/2013

(Continued)

OTHER PUBLICATIONS

"Diamond Dash Baseball/Softball Bat Bags," http://baseball.epicsports.com/cat/3/r0/f-s2/bags.html?term=diamond+dash+baseball (Last Accessed on Feb. 25, 2015) 2 pgs.

(Continued)

*Primary Examiner* — Brian D Nash
(74) *Attorney, Agent, or Firm* — Richard C. Litman

(57) ABSTRACT

A secured sports equipment backpack includes a top compartment having a wet storage section, a dry storage section, and a separator wall separating the wet storage section from the dry storage section. The dry storage section includes a first compartment having either a substantially spherical shape or an elongated sleeve. A bottom compartment of the back pack has a plurality of sub-compartments. The backpack includes a plurality of clips in the wet storage section. A plurality of extendible security cables are detachably connected to a respective clip at one end. A second end of the security cables is coupled to the separator wall. The security cables can be detached from the clips, wrapped around another bag or object, and then reattached to the clip to facilitate carrying one or more additional bags or objects together with the backpack.

7 Claims, 7 Drawing Sheets

(56) References Cited

U.S. PATENT DOCUMENTS 5,062,557 A * 11/1991 Mahvi ..... A45C 7/0086 190/108
5,431,265 A * 7/1995 Yoo ..... A45C 3/00 190/103
5,458,278 A * 10/1995 LaConte ..... A45C 13/103 224/153
5,509,279 A * 4/1996 Brown ..... A45C 11/20 62/371
5,586,703 A * 12/1996 Radar ..... A45F 3/04 224/148.2
5,803,332 A * 9/1998 Thompson ..... A45F 3/04 224/153
5,975,293 A 11/1999 Fowler
6,024,264 A * 2/2000 Java ..... A45B 3/00 135/16
6,367,674 B1 4/2002 Tabor
6,612,472 B1 9/2003 Zakarin
6,651,853 B2 * 11/2003 Higgins ..... A45F 3/04 224/155
6,719,306 B2 * 4/2004 White ..... A63B 47/002 206/315.5
7,959,048 B1 * 6/2011 Cyr ..... A45C 5/06 224/651
8,123,581 B2 * 2/2012 Aschauer ..... A63B 29/021 116/210
8,281,970 B2 10/2012 Demskey
8,607,985 B2 12/2013 Tauchen
D699,432 S 2/2014 Hock
8,651,353 B2 * 2/2014 Koutouras ..... A45C 13/02 224/580
9,119,448 B1 * 9/2015 Hirshberg ..... A45C 7/0077
9,173,462 B2 * 11/2015 Thompson ..... A45C 7/0022
9,345,301 B2 * 5/2016 Brouard ..... A45C 13/36
2003/0205601 A1 * 11/2003 Kilduff ..... A01K 1/0254 224/627
2004/0149793 A1 * 8/2004 Theodore ..... A45C 7/0095 224/576
2010/0147918 A1 6/2010 Hensley et al.
2012/0031943 A1 2/2012 Koutouras
2014/0061273 A1 * 3/2014 Bullivant ..... A45F 3/04 224/576

FOREIGN PATENT DOCUMENTS

CN 203662150 U 6/2014
GB 2 388 312 A 11/2003
GB 2492336 A 1/2013
GB 2506437 A 4/2014
JP 2011-156326 8/2011
KR 10-2012-0017176 2/2012

OTHER PUBLICATIONS

"HAPNT Sports Backpack With Shoe Compartment," http://www.alibaba.com/product-detail/Hapnt-sports-backpack-with-shoe-compartment 610480110.html (Last Accessed on Feb. 19, 2015) 2pgs.

* cited by examiner

SECURED SPORTS EQUIPMENT BACKPACK

BACKGROUND OF THE INVENTION

1. Field of the Invention

The present invention generally relates to sports totes and, more particularly, to a secured sports equipment backpack.

2. Description of the Related Art

Many individuals who play sports are required to carry around their own sporting equipment to practices and games. For example, individuals who play baseball typically have to carry around their own baseball bat(s), glove(s), cleats, a pair of extra sneakers for use after the game, as well as their uniform and a change of clothes for after the game. Soccer players, on the other hand, typically carry around a soccer ball, shin guards, cleats (as well as a pair of sneakers for use after the game), as well as their uniform and a change of clothes for after the game. Not only must they carry around all this equipment, but they must also find an efficient, lightweight, and non-cumbersome way of transporting the equipment to the practice or game.

Thus, a secured sports equipment bag solving the aforementioned problems is desired.

SUMMARY OF THE INVENTION

A secured sports equipment backpack includes a top compartment having a wet storage section, a dry storage section, and a separator wall separating the wet storage section from the dry storage section. The dry storage section includes a first compartment having either a substantially spherical shape or an elongated sleeve for carrying sports equipment. A bottom compartment of the back pack has a plurality of sub-compartments. The backpack includes a plurality of clips in the wet storage section. A plurality of extendible security cables are detachably connected to a respective clip at one end. A second end of the security cables is coupled to the separator wall. The security cables can be detached from the clips, wrapped around another bag or object, and then reattached to the clip to facilitate carrying one or more additional bags or objects together with the backpack. A plurality of adjustable arm straps, as are known with standard backpacks, can be coupled to a back portion of the secured sports equipment backpack. A carrying handle can be positioned on the top of the backpack.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
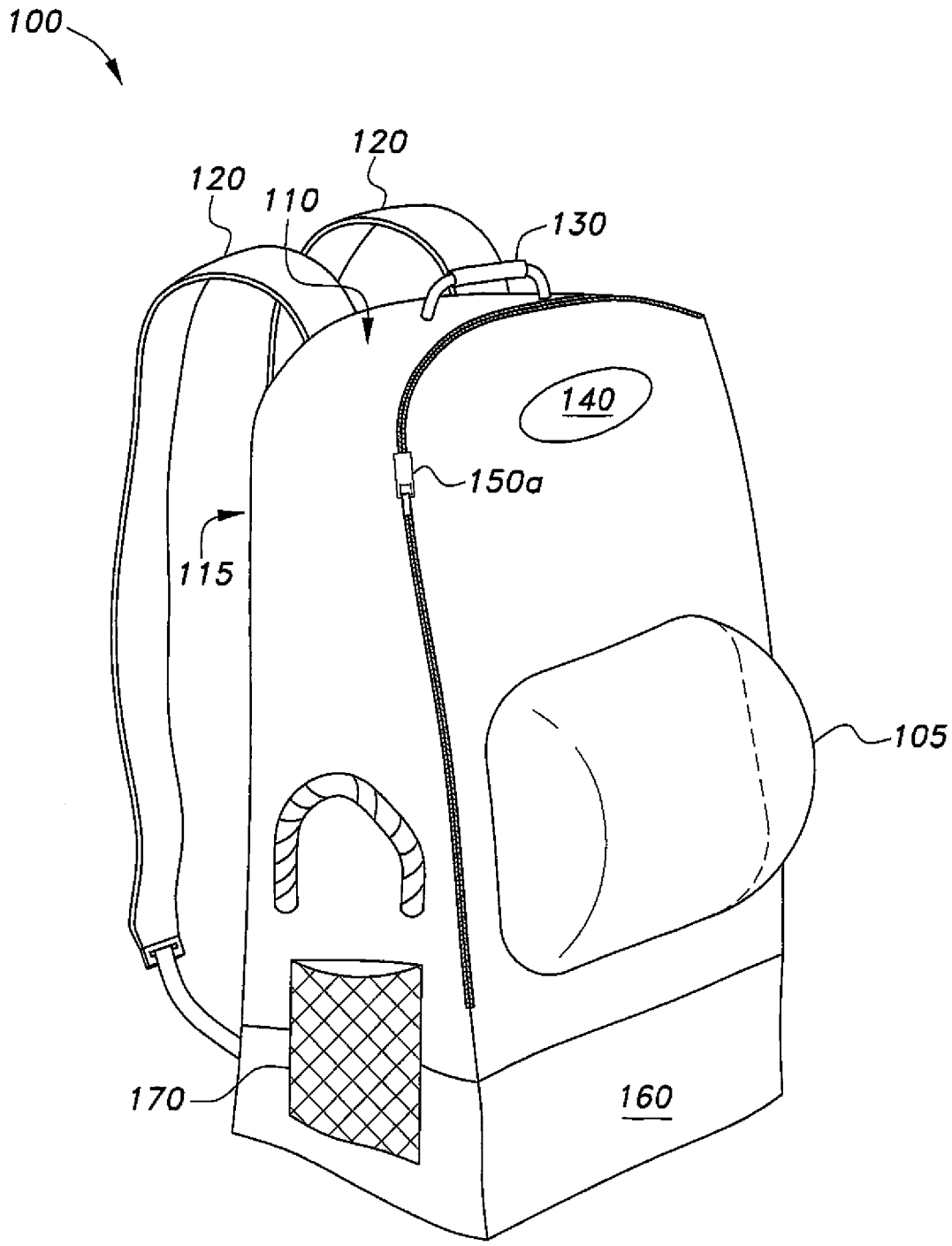
FIG. 1 is an environmental view of an embodiment of a secured sports equipment backpack according to the present invention.
Figure 2:
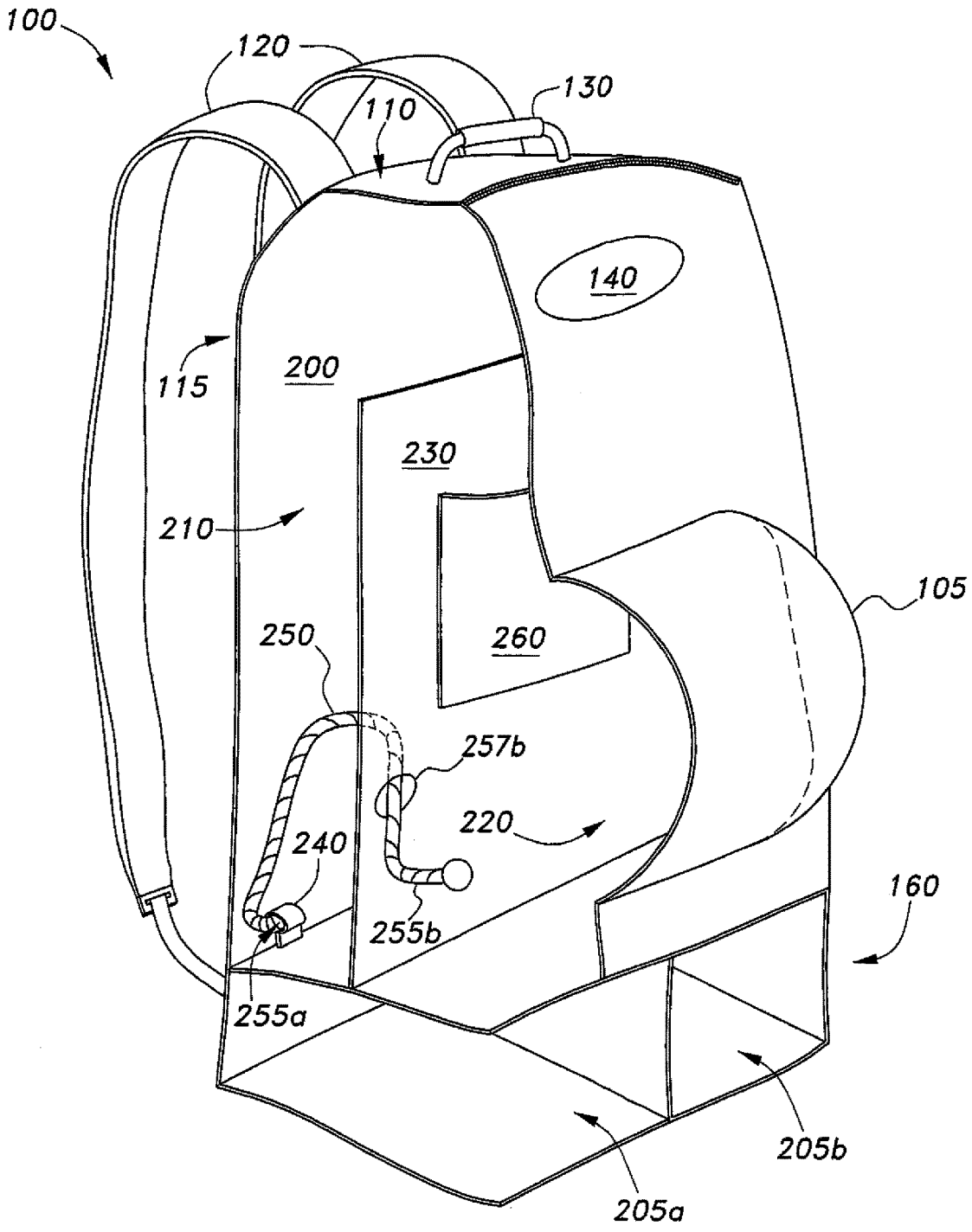
FIG. 2 is a cross-sectional view of the interior of an embodiment of a secured sports equipment backpack according to the present invention.
Figure 3:
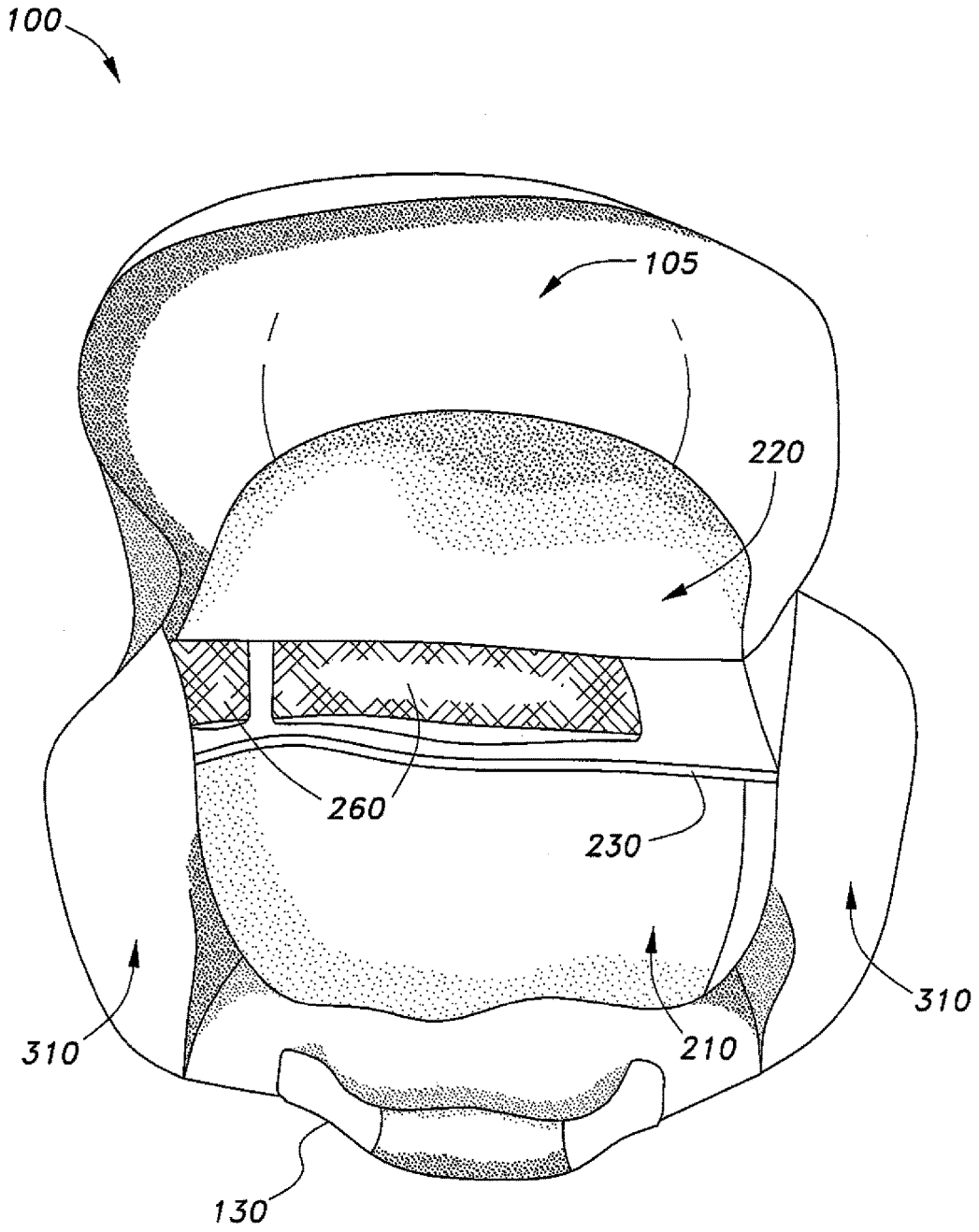
FIG. 3 is top view of the interior of an embodiment of a secured sports equipment backpack according to the present invention.

Referring to FIGS. 1-3, an embodiment of a secured sports equipment backpack 100 is generally illustrated. The backpack 100 can include a top compartment 110 including a wet storage section 210, such as a wet storage section for a wet bathing suit or, otherwise, soiled or sweaty clothing, a dry storage section 220, such as a dry storage section for a change of clothes, and a wet/dry separator 230 configured for separating the wet storage section 210 from the dry storage section 220 so as to maintain the wet contents and the dry contents separated. The dry storage section 220 can include a substantially spherical-shaped compartment 105 configured for holding and/or for storing a substantially spherical object, such as a soccer ball, football, or basketball. A plurality of adjustable arm straps 120 (desirably two adjustable arm straps), as are known with standard backpacks, can be coupled to a back portion 115 of the secured sports equipment backpack. A carrying handle 130 can be positioned on the top of the backpack 100 (as illustrated in FIGS. 1 and 2). A logo area 140 for displaying a mark or brand can be provided on an exterior of the backpack. A bottom compartment 160 having a plurality of sub-compartments, such as a first sub-compartment 205*a* configured for holding and/or storing shin guards, and a second sub-compartment 205*b* configured for holding and/or storing cleats (FIG. 2) can be provided at the bottom of the backpack. A plurality of releasable fasteners can be provided, such as a first combination zipper 150*a* configured for opening and closing the top compartment 110 and a second combination zipper 150*b* (FIG. 4) configured for opening and closing the bottom compartment 160. The backpack 100 can include a plurality of mesh pockets 170, such as a mesh pocket positioned on the right side and a mesh pocket positioned on the left side of the backpack 100. Each mesh pocket can be configured for holding ancillary equipment, such as water bottle(s), sun screen bottle(s), and umbrella(s).

The backpack 100 can include a plurality of clips 240 in the wet storage section 210, and a plurality of security cables 250 (desirably a security cable on the left side and a security cable on the right side of the backpack 100). Each of the plurality of security cables 250 can have a first end 255*a* detachably coupled to one of the plurality of clips 240 and a second end 255*b* coupled to the wet/dry separator 230. The security cables 250 can be extendible. The backpack 100 can have a first opening 257*b* through which respective ends of the plurality of security cables 250 can extend. It is to be noted that the plurality of security cables 250 can be disconnected from the plurality of clips 240 in the wet storage section 210 of the backpack 100. For example, security cable 250 can be detached from clip 240, wrapped around another bag or object, and then reattached to the clip 240 to facilitate carrying one or more additional bags or objects together with the backpack 100.

The wet/dry separator 230 can include at least one slot 260 (desirably two slots), such as a slot configured for holding and/or storing a communications device, such as a laptop, such as a MacBook®, a smartphone, such as an iPhone®, and/or a tablet, such as a Surface®. The at least one slot 260 can be centrally located in the wet/dry separator 230.

Figure 4:
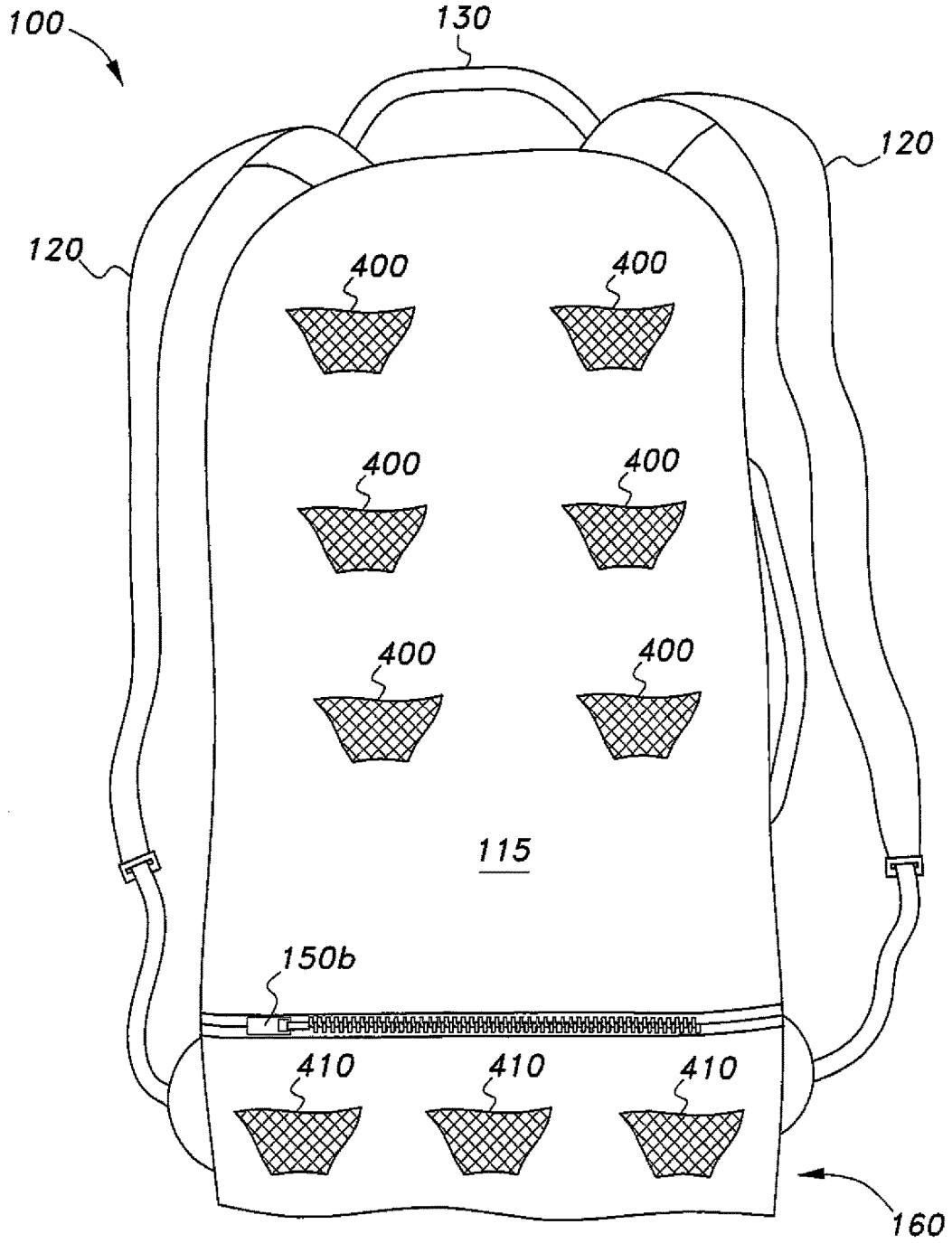
FIG. 4 is a back view of an embodiment of a secured sports equipment backpack according to the present invention.

Referring to FIGS. 3 and 4, the backpack 100 can also include a plurality of air vents, such as a plurality of primary air vents 310 positioned on left and right sides of the backpack 100 so as to aerate the wet storage section 210, a plurality of secondary air vents 400 positioned on the back side 200 of the backpack 100 so as to further aerate the wet storage section 210, and a plurality of tertiary air vents 410 positioned on the bottom compartment 160, such as on the back portion of the bottom compartment 160 (as illustrated in FIG. 4), so as to aerate the first sub-compartment 205*a* and the second sub-compartment 205*b* of the bottom compartment 160.

By way of operation, after selecting the correct combination on the first combination zipper 150*a* and the second combination zipper 150*b* so as to unlock the first combination zipper 150*a* and the second combination zipper 150*b*, a user can open the top compartment 110 and the bottom compartment 160 of the backpack 100 by unzipping the first combination zipper 150*a* and the second combination zipper 150*b*, respectively. After the top compartment 110 and the bottom compartment 160 of the backpack 100 are open, a substantially spherical object, such as a soccer ball, football, or basketball, can be disposed in the compartment 105. Cleats and shin guards can be disposed in the first sub-compartment 205*a* and the second sub-compartment 205*b*, respectively.

A user can dispose sweaty or, otherwise, soiled clothing into the wet storage section 210, a spare shirt into the dry storage section 220, a communications device, such as a tablet, in the at least one slot 260 centrally located in the wet/dry separator 230.

After all the contents have been inserted into the backpack 100, the user can close the backpack 100, such as by zipping the first combination zipper 150*a* and the second combination zipper 150*b* so as to close the first compartment 105 and the bottom compartment 160, respectively. The backpack 100 can be further secured by resetting the first combination zipper 150*a* and the second combination zipper 150*b*. Further, a water bottle can be inserted into one of the plurality of mesh pockets 170.

The backpack 100 can be made from any type of suitable material, such as fabric, that is durable, waterproof, and can hold the contents, such as the soccer ball and/or the baseball bat BB, stored within the backpack 100. The backpack 100 can also have any suitable dimensions, such as a height of 19.5 inches, a width of 14.5 inches, and a depth of 10 inches, sufficient to accommodate the contents stored within the backpack 100. It is also to be noted that the backpack 100 can have a liner, such as a cut resistant liner, so as to secure the contents inside the backpack.

The bottom compartment 160 can be made from any type of suitable material, such as fabric, that is durable or substantially durable, and waterproof. The bottom compartment 160 can have any suitable dimensions such as a width of 14.5 inches and a depth of 10 inches, sufficient to accommodate the contents stored within the bottom compartment 160.

Figure 5:
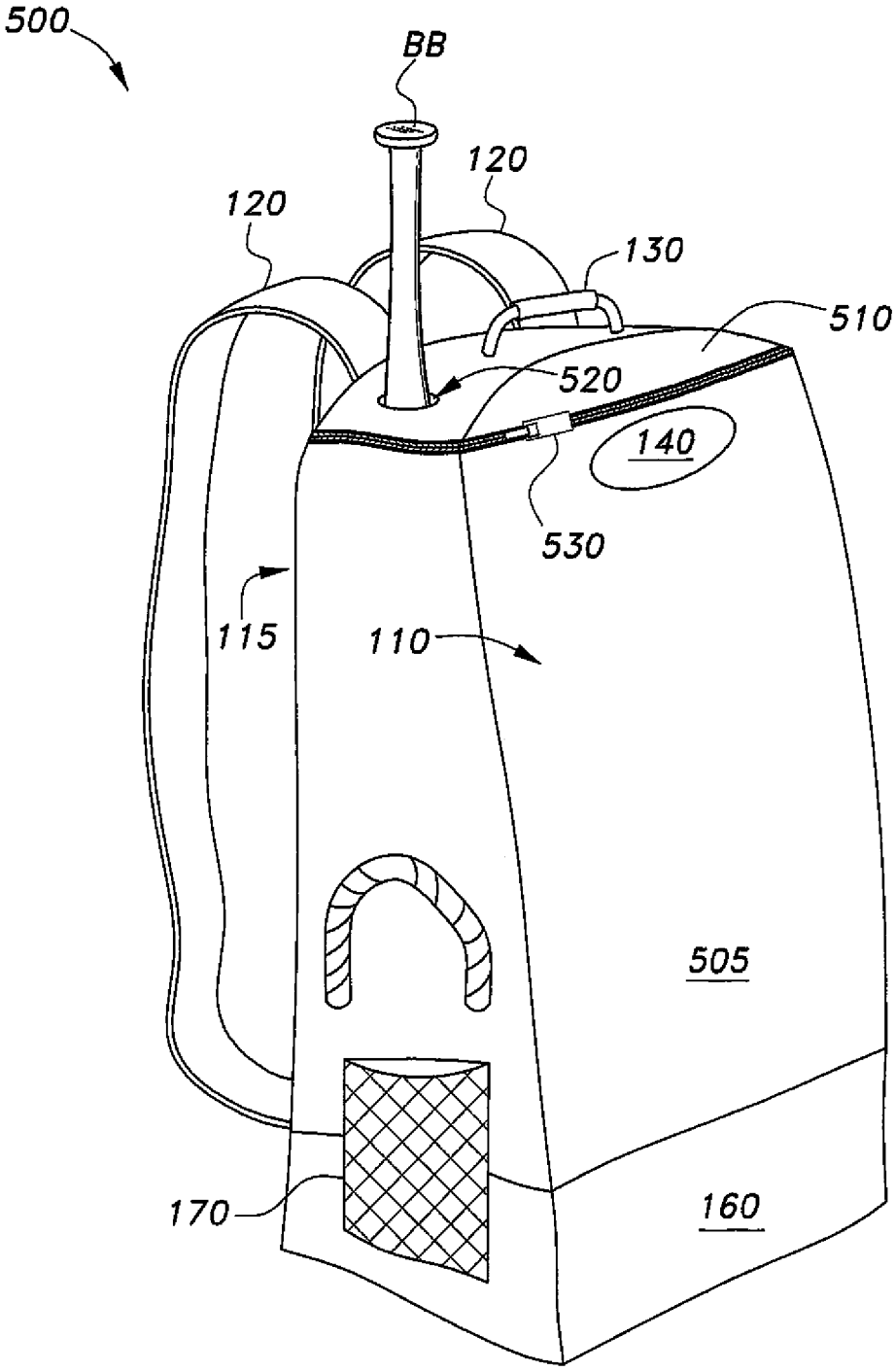
FIG. 5 is an environmental view of an alternative embodiment of a secured sports equipment backpack according to the present invention.
Figure 6:
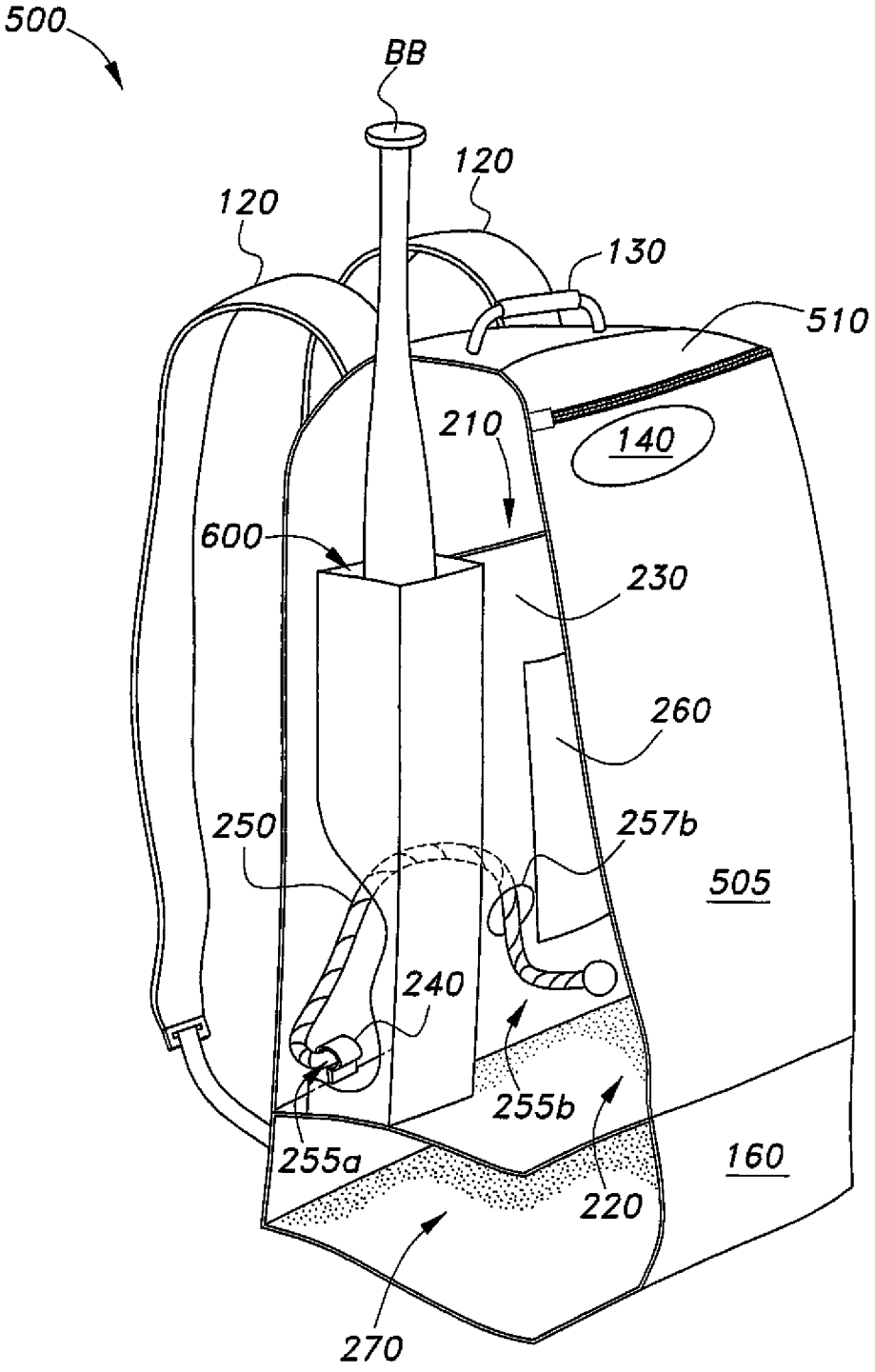
FIG. 6: is a cross-sectional view of the interior portion of the alternative embodiment of a secured sports equipment backpack according to the present invention.
Figure 7:
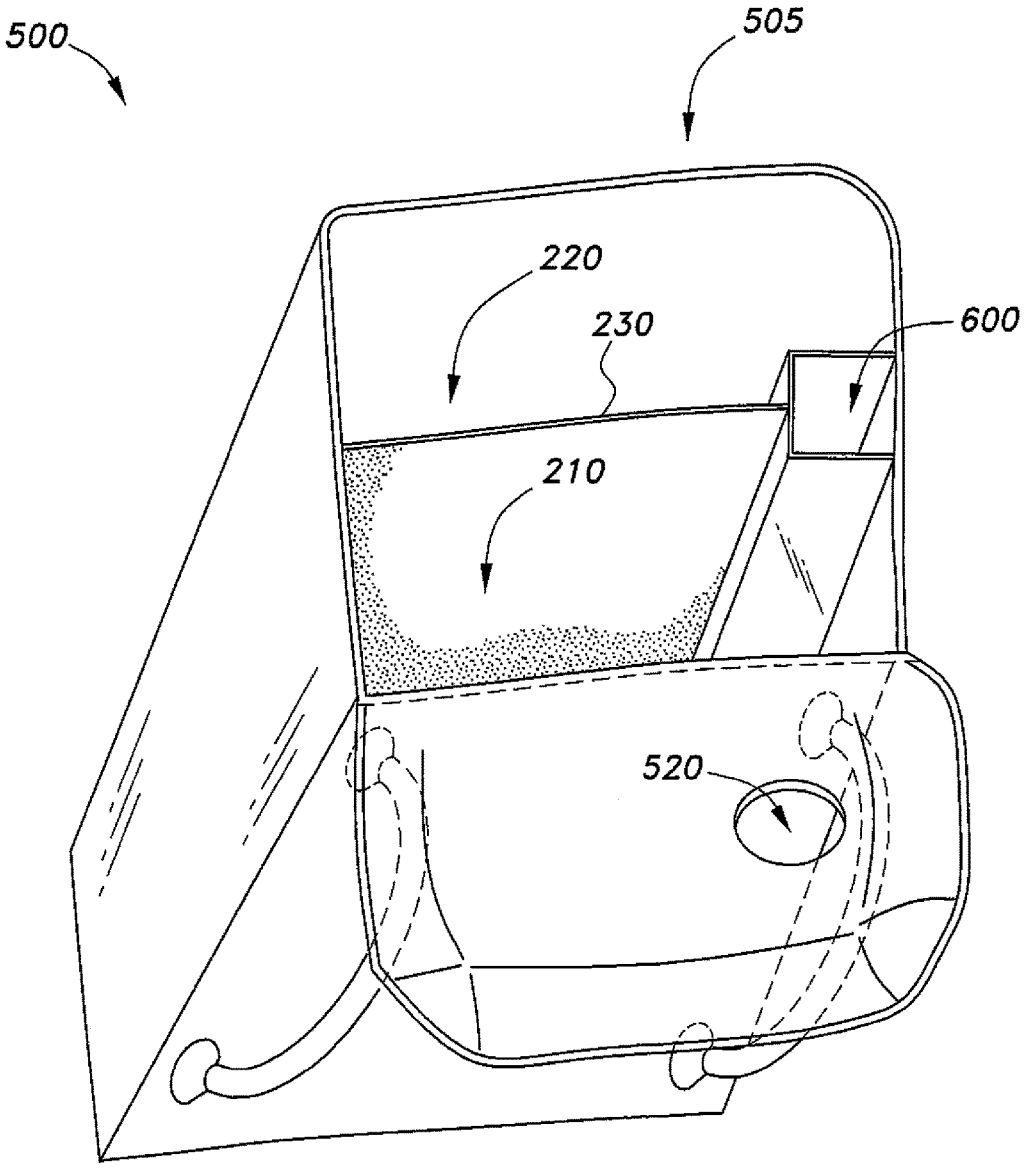
FIG. 7 is a top view of the interior of the alternative embodiment of a secured sports equipment backpack according to the present invention.

Referring to FIGS. 5-7, an alternative embodiment of the backpack, designated 500, is shown in the drawings. Backpack 500 can include a compartment 505 having an elongated, substantially square shaped sleeve 600 configured for holding and/or storing a substantially elongated object, such as a baseball bat BB, a golf club, a hockey stick, and a croquet stick. It is to be noted that that sleeve 600 can be formed from any type of suitable material, such as a padded material, that can protect the substantially elongated object. The alternative embodiment 500 is substantially similar to the backpack 100 described above. One difference between the backpack 100 described above and the alternative embodiment 500 is that instead of the compartment 105, the alternative embodiment 500 includes the elongated, substantially square shaped sleeve 600 configured for holding and/or storing the substantially elongated object.

The alternative embodiment 500 can also include an upper flap 510 having a second opening 520 and a secondary securing means, such as a third combination zipper 530, configured for opening and closing the upper flap 510. It is to be noted that the alternative embodiment 500 can have a fourth combination zipper (not shown) similar to the second combination zipper 150*b* illustrated in FIG. 4 to open and close the bottom compartment 160.

By way of operation, after selecting the correct combination on the third combination zipper 530 so as to unlock the third combination zipper 530, a user can insert the baseball bat BB into the elongated, substantially square shaped sleeve 600. Once the baseball bat BB has been inserted into the elongated, substantially square shaped sleeve 600, the upper flap 510 can be closed on top of the compartment 505 such that the handle portion of the baseball bat BB extends through the second opening 520 in the upper flap 510. The upper flap 510 can then be secured, such as by zipping the third combination zipper 530 until the entire upper flap 530 has been secured. It is to be noted that the second opening 520 can have any suitable diameter, such as a diameter large enough to secure the handle of the baseball bat BB, but small enough to restrict the removal of the baseball bat BB from the backpack 500, without first opening the upper flap 510. Further, the bottom portion 160 can be opened and closed in a similar fashion as with the bottom portion 160 described above.

It is to be understood that the present invention is not limited to the embodiments described above, but encompasses any and all embodiments within the scope of the following claims.

I claim:

1. A secured sports equipment backpack, comprising:

a top compartment and a bottom compartment, wherein the top and bottom compartments are defined by a front wall, a rear wall and opposed side walls, the top compartment having a wet storage section at the front of the backpack, a dry storage section at the back of the backpack; a separator wall for separating the wet storage section from the dry storage section, wherein the wet storage section constitutes a compartment defined by the bottom compartment, the front wall and the separator wall, and the dry storage section constitutes a compartment defined by the bottom compartment, the rear wall and the separator wall;

a plurality of adjustable arm straps coupled to the front wall of the backpack;

a plurality of air vents extending through at least one of the sides of the backpack adjacent to the wet storage section;

a plurality of mesh pockets disposed on the side walls of the backpack, each mesh pocket configured for holding ancillary equipment;

a carrying handle on the top of the secured sports equipment backpack;

a plurality of clips disposed solely in the wet storage section;

a plurality of security cables, each of the plurality of security cables having a first end detachably coupled to one of the plurality of clips and a second end coupled to the separator wall; and a plurality of releasable fasteners connected to the top compartment and the bottom compartment.

2. The secured sports equipment backpack according to claim 1, wherein the plurality of releasable fasteners includes a first combination zipper connected to the top compartment and a second combination zipper connected to the bottom compartment.

3. The secured sports equipment backpack according to claim 1, wherein the rear wall further includes a substantially spherical shaped portion configured for holding a substantially spherical object.

4. The secured sports equipment backpack according to claim 1, wherein the plurality of security cables are extendible.

5. The secured sports equipment backpack according to claim 1, wherein the separator wall includes at least one slot configured for holding a communication device.

6. The secured sports equipment backpack according to claim 1, wherein the plurality of air vents are defined in one or more sides of the wet storage portion and the bottom portion.

7. The secured sports equipment backpack according to claim 1, wherein the top compartment further includes an elongated, substantially square shaped sleeve configured for holding a substantially elongated object.

* * * * *